US008720626B2

(12) United States Patent
Mirzaei

(10) Patent No.: US 8,720,626 B2
(45) Date of Patent: May 13, 2014

(54) MOTOR DRIVE SYSTEM

(75) Inventor: Saeid Mirzaei, Greendale, WI (US)

(73) Assignee: Caterpillar Global Mining LLC, South Milwaukee, WI (US)

( * ) Notice: Subject to any disclaimer, the term of this patent is extended or adjusted under 35 U.S.C. 154(b) by 0 days.

(21) Appl. No.: 13/596,949

(22) Filed: Aug. 28, 2012

(65) Prior Publication Data

US 2014/0064986 A1 Mar. 6, 2014

(51) Int. Cl.
*B60K 11/00* (2006.01)

(52) U.S. Cl.
USPC ..... 180/68.1

(58) Field of Classification Search
USPC ..... 180/68.1
See application file for complete search history.

(56) References Cited

U.S. PATENT DOCUMENTS

| | | | | |
|---|---|---|---|---|
| 2,991,396 | A * | 7/1961 | Schurr | 361/11 |
| 3,581,172 | A * | 5/1971 | Tsuboi et al. | 318/259 |
| 4,108,264 | A * | 8/1978 | Tanaka | 180/2.1 |
| 4,264,894 | A * | 4/1981 | Ellington | 714/4.4 |
| 5,396,214 | A * | 3/1995 | Kumar | 338/279 |
| 6,121,695 | A * | 9/2000 | Loh | 307/64 |
| 7,692,430 | B2 * | 4/2010 | Emori et al. | 324/430 |
| 7,746,604 | B2 | 6/2010 | McNally et al. | |
| 8,102,077 | B2 * | 1/2012 | Neher | 307/9.1 |
| 8,251,168 | B2 * | 8/2012 | Bharani et al. | 180/68.1 |
| 2004/0145844 | A1 * | 7/2004 | Franke et al. | 361/93.1 |
| 2005/0162796 | A1 * | 7/2005 | Arenz et al. | 361/97 |
| 2006/0247795 | A1 * | 11/2006 | Gass et al. | 700/1 |
| 2007/0008741 | A1 * | 1/2007 | Al-Khayat et al. | 363/16 |
| 2007/0266074 | A1 * | 11/2007 | Dellacona | 709/201 |
| 2008/0211415 | A1 * | 9/2008 | Altamura | 315/192 |
| 2009/0293760 | A1 * | 12/2009 | Kumar et al. | 105/59 |
| 2011/0122667 | A1 * | 5/2011 | Mino et al. | 363/125 |
| 2012/0230843 | A1 * | 9/2012 | Ravipati et al. | 417/46 |
| 2012/0275069 | A1 * | 11/2012 | Dooley | 361/31 |

FOREIGN PATENT DOCUMENTS

| | | |
|---|---|---|
| JP | 56035603 | 4/1981 |

* cited by examiner

*Primary Examiner* — Jeffrey J Restifo
*Assistant Examiner* — Erez Gurari
(74) *Attorney, Agent, or Firm* — Foley & Lardner LLP

(57) ABSTRACT

System and methods for driving a blower motor of a vehicle such as a mining truck or locomotive are provided. A drive system includes a blower drive circuit configured to receive power from an alternator and use the power from the alternator to drive the blower motor. The blower drive circuit is further configured to receive power from at least one traction motor of the vehicle during a retarding operation of the vehicle and use the power from the at least one traction motor to drive the blower motor. The drive system further includes a bypass circuit configured to electrically isolate the blower motor from the blower drive circuit when a fault is detected in the blower drive circuit and to provide power from the alternator to the blower motor such that the blower motor remains operable without use of the blower drive circuit.

19 Claims, 7 Drawing Sheets

MOTOR DRIVE SYSTEM

BACKGROUND

The present disclosure relates generally to the field of electric drive systems for motors. More specifically, the present disclosure relates to systems and methods for driving blower motors used to cool various components of a vehicle.

Industrial vehicles, such as mining trucks and locomotives, with electric or hybrid drive systems often include large components, such as motors and alternators, that generate a substantial amount of heat. These components may be cooled using blower motors or other cooling mechanisms designed to help dissipate heat.

Blowers may be used to cool several components of a vehicle, such as alternators, motors, and resistors that may be used to dissipate electrical energy. U.S. Pat. No. 7,746,604 ("the '604 patent") of McNally et al., which issued on Jun. 29, 2010, discloses a system that utilizes a blower to cool a series of resistors. The system of the '604 patent includes a first series of resistors connected in series, a second series of resistors connected in series, a blower, and a sensor. When a current value, blower speed, and/or voltage value changes, the grid network of resistors is disconnected.

Conventional portions of electric drive systems used to drive blower motors in vehicles are electrically separated from other portions of the electric drive systems used to drive other components, such as traction motors. Such blower drive systems consume energy generated by the engine by burning fuel and do not take advantage of electrical energy that may be returned by other electrical components during certain operating modes of the vehicle (e.g., the traction motors). The circuits that are used to drive the blower motors may also be subject to faults that can stop operation of the blowers, causing costly downtime for the vehicle.

The electric drive systems of the present disclosure solve one or more problems set forth above and/or other problems of the prior art.

SUMMARY

One embodiment of the disclosure relates to a drive system for a blower motor of a vehicle. The vehicle has at least one traction motor configured to move at least a portion of the vehicle. The blower motor is configured to cool the at least one traction motor. The drive system includes a blower drive circuit configured to receive power from an alternator and use the power from the alternator to drive the blower motor. The blower drive circuit is further configured to receive power from the at least one traction motor during a retarding operation of the vehicle and use the power from the at least one traction motor to drive the blower motor. The drive system further includes a bypass circuit configured to electrically isolate the blower motor from the blower drive circuit when a fault is detected in the blower drive circuit and to provide power from the alternator to the blower motor such that the blower motor remains operable without use of the blower drive circuit.

Another embodiment relates to a vehicle including an alternator, at least one traction motor configured to move at least a portion of the vehicle, and a blower motor configured to cool the at least one traction motor and the alternator. The vehicle further includes a traction drive circuit configured to receive power from the alternator and drive the at least one traction motor with the power from the alternator. During a retarding operation, the traction drive circuit is configured to receive power from the at least one traction motor and to dissipate at least a portion of the power received from the at least one traction motor as heat. The vehicle further includes a blower drive circuit configured to receive power from the alternator and use the power from the alternator to drive the blower motor. The blower drive circuit is electrically connected to the traction drive circuit. During the retarding operation, the blower drive circuit is configured to receive from the traction drive circuit a portion of the power received by the traction drive circuit from the at least one traction motor. The blower drive circuit is configured to use the power from the at least one traction motor to drive the blower motor. The vehicle further includes a bypass circuit configured to electrically isolate the blower motor from the blower drive circuit when a fault is detected in the blower drive circuit and to provide power from the alternator to the blower motor such that the blower motor remains operable without use of the blower drive circuit.

Another embodiment relates to a method of providing power to a blower motor of a vehicle. The vehicle has at least one traction motor configured to move at least a portion of the vehicle. The blower motor is configured to cool the at least one traction motor. The method includes receiving, at a blower drive circuit, power from an alternator and using the power from the alternator to drive the blower motor. The method further includes receiving, at the blower drive circuit during a retarding operation of the vehicle, power from the at least one traction motor and using the power from the at least one traction motor to drive the blower motor. The method further includes determining whether a fault exists within the blower drive circuit. The method further includes, when a fault exists within the blower drive circuit, electrically isolating the blower drive circuit from the alternator, the at least one traction motor, and the blower motor and providing power from the alternator to the blower motor through a bypass circuit to enable the blower motor to remain operable without use of the blower drive circuit.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Figure 1:
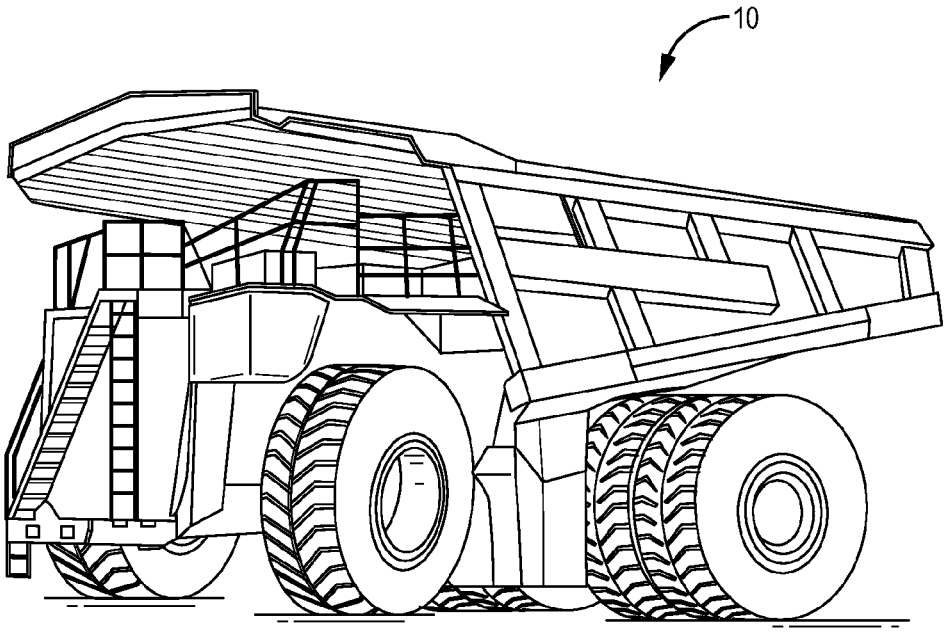
FIG. 1 is an illustration of a mining truck according to an exemplary embodiment.

Referring generally to the figures, systems and methods for providing power to a blower motor for use in cooling components of a vehicle, such as a mining truck or locomotive, are shown according to various exemplary embodiments. Large industrial vehicles such as mining trucks or locomotives often include components that produce a substantial amount of heat. Such vehicles may utilize cooling systems, such as blowers designed to push air over the hot components, to help dissipate heat in order to avoid damage to the components due to excessive heat and to prolong the life of the components. For example, mining trucks may use one or more blowers to push air over the windings of alternators and traction motors (e.g., motors designed to move one or more parts or sides of the vehicles). An example mining truck 10 is illustrated in FIG. 1 according to an exemplary embodiment.

The present disclosure provides systems and methods for providing power to blower motors in a manner that is more energy efficient, cost efficient and reliable than other solutions. A blower drive circuit receives power from an alternator of a vehicle and uses the power to drive a blower motor used to cool components (e.g., one or more traction motors and/or an alternator) of the vehicle. The blower drive circuit may be connected to the alternator through a fractional tap (e.g., a ¼ tap) of the alternator or transformer, and the power received at the blower drive circuit may have a voltage that is substantially lower than the operating voltage of the alternator (e.g., ¼ the operating voltage level of the alternator). The blower drive circuit may also be connected to a traction drive circuit configured to provide power from the alternator to one or more traction motors. During a retarding operation of the vehicle designed to slow down or stop movement of part or all of the vehicle, power is returned to the traction drive circuit from the traction motors. The traction drive circuit may be configured to dissipate the energy from the traction motors as heat using resistors. The blower drive circuit may be configured to receive a portion of the power from the traction motors through the traction drive circuit during the retarding operation and use the power to drive the blower motor. This may reduce the amount of fuel needed to drive the blower motors by using energy from the traction motors that would otherwise have been wasted as heat.

In some embodiments, the blower drive circuit may be capable of being electrically isolated from the rest of the electrical system of the vehicle. For example, the blower drive circuit may be connected to the alternator, traction drive circuit, and blower motor through contactors that can be closed to connect the blower drive circuit with those components and opened to isolate the blower drive circuit. The contactors may be configured to isolate the blower drive circuit when a fault is detected in one of the components of the blower drive circuit. When the blower drive circuit is isolated, power may be routed from the alternator to the blower motor through a bypass circuit so that the vehicle can continue operating while the fault in the blower drive circuit is addressed. In some embodiments, the blower drive circuit can be disconnected from the contactors and completely removed from the vehicle without stopping operation of the vehicle, such that the blower drive circuit can be repaired or maintained at a location separate from the vehicle and the vehicle can continue to operate.

Figure 2:
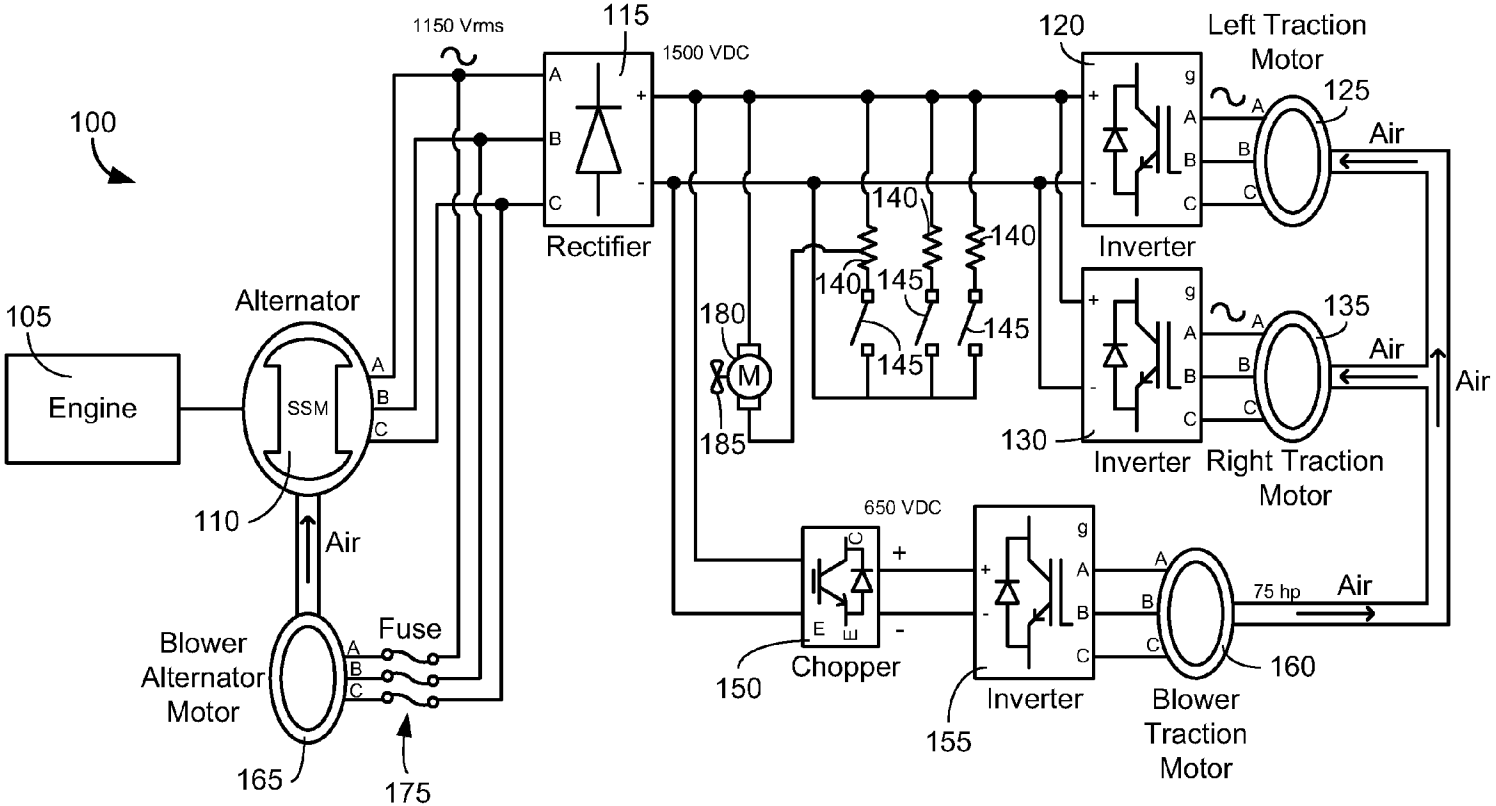
FIG. 2 is a schematic diagram of motor drive circuit according to an exemplary embodiment.

A variety of drive systems may be used to drive blower motors used to cool components of industrial vehicles such as mining trucks or locomotives. FIG. 2 illustrates a schematic diagram of a motor drive circuit 100 according to one exemplary embodiment. Circuit 100 includes an alternator 110 that is driven by an engine 105 and is configured to generate electrical power used by an electrical drive system of a vehicle. Three-phase alternating current (AC) power is transmitted from alternator 110 to a rectifier 115 configured to convert the three-phase AC power into direct current (DC) power. The DC power is subsequently transmitted from rectifier 115 to an inverter 120 configured to convert the DC power into AC power and to transmit the AC power to a first traction motor 125. The DC power is also transmitted from rectifier 115 to an inverter 130 configured to convert the DC power into AC power and to transmit the AC power to a second traction motor 135. In some embodiments, traction motors 125 and 135 may be configured to move different parts of the vehicle (e.g., a left side and a right side, a front end and a back end, etc.).

A portion of the DC power may also be transmitted to a chopper 150 configured to receive the DC power at a high voltage (e.g., 1500 VDC) and to drop the voltage to a lower voltage (e.g., 650 VDC). The lower voltage DC power may then be converted into AC power using an inverter 155, and the lower voltage AC power may be used to drive a traction blower motor 160 configured to cool traction motors 125 and 135. In the illustrated embodiment, a separate alternator blower motor 165 is driven directly by the AC output of alternator 110 and is configured to cool alternator 110. The alternator blower motor 165 may be protected by fuses 175.

The vehicle may be configured to enter a retarding mode in which one or both of the traction motors 125 and 135 are configured to slow or stop movement of the vehicle. In the retarding mode, traction motors 125 and 135 return some energy to the traction drive circuit. The voltage of the power from traction motors 125 and 135 is higher than that generated by alternator 110 during the retarding operation, reversing the current flow through circuit 100. One or more switches 145 may be configured to close at the onset of the retarding operation, closing a portion of the circuit including grid resistors 140. Grid resistors 140 are illustrated as including three resistors; however, grid resistors 140 may include a grid or array of any number of resistors in various exemplary embodiments. Rectifier 115 prevents flow of current back to alternator 110, and the current returned from traction motors 125 and 135 flows through grid resistors 140. Grid resistors 140 dissipate the returned energy as heat. Grid resistors 140 are cooled by a DC motor 180 which is connected to a fan 185. A portion of the returned energy may flow through chopper 150 and inverter 155 to traction blower motor 160 and may be used to cool traction motors 125 and 135.

Figure 3:
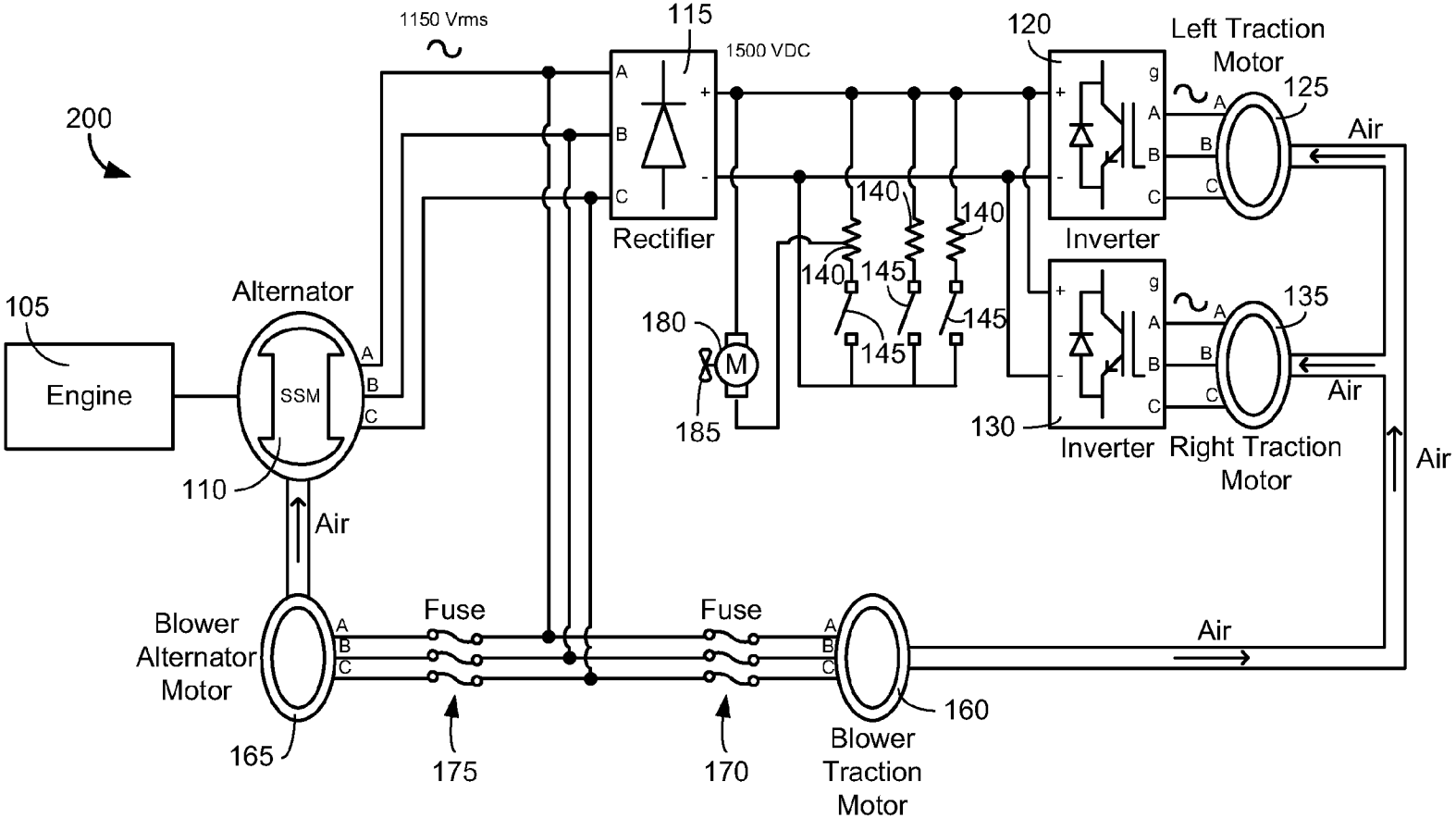
FIG. 3 is a schematic diagram of motor drive circuit according to another exemplary embodiment.

FIG. 3 illustrates a schematic diagram of another motor drive circuit 200 according to another exemplary embodiment. Circuit 200 includes many of the same components as circuit 100, and similar components generally operate in the manner described with respect to FIG. 2. However, in circuit 200, both alternator blower motor 165 and traction blower motor 160 are connected to the AC output of alternator 110. Blower motors 160 and/or 165 may be connected through fuses 170, 175. Fuses 170 protect traction blower motor 160, and fuses 175 protect alternator blower motor 165.

Figure 4:
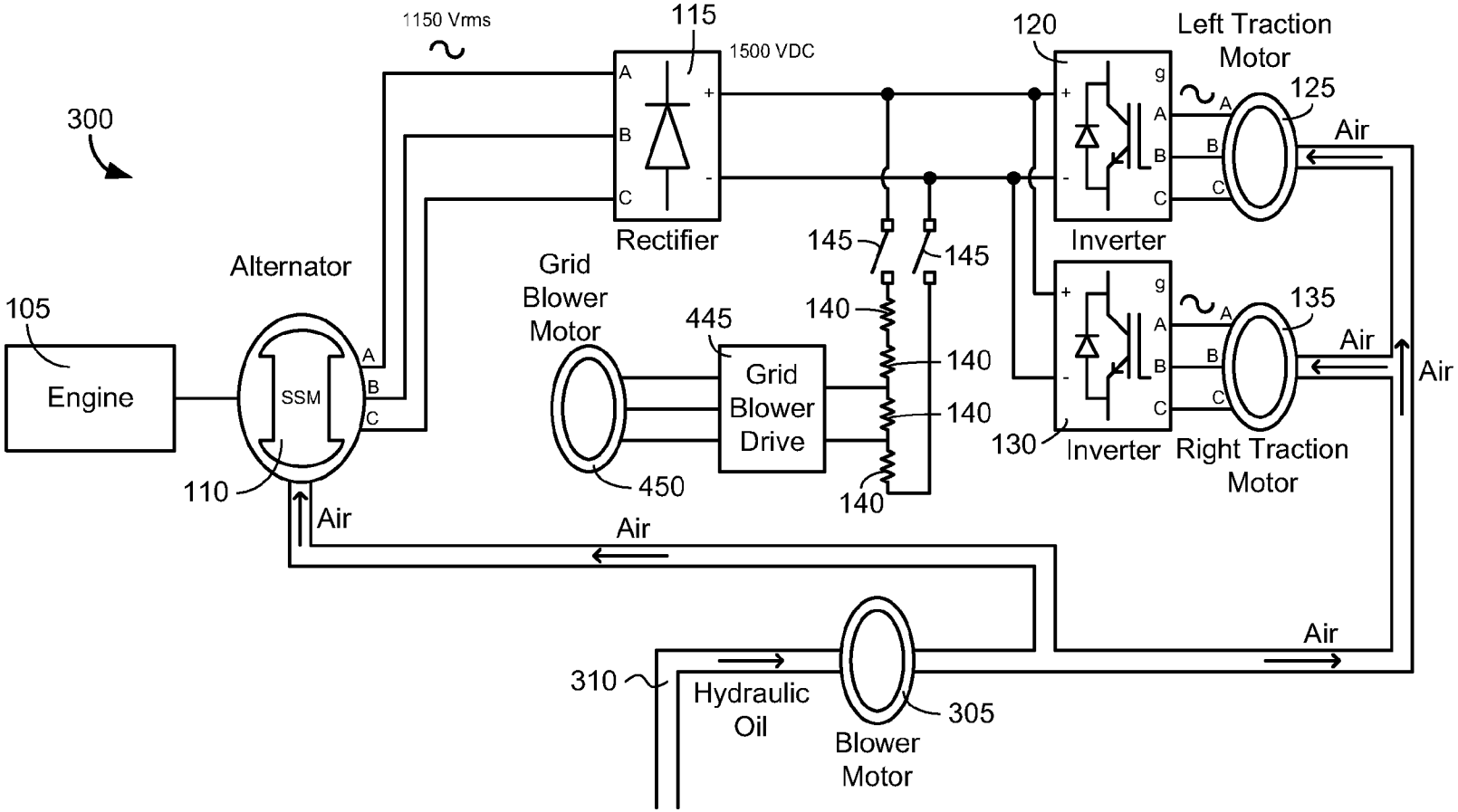
FIG. 4 is a schematic diagram of motor drive circuit according to yet another exemplary embodiment.

FIG. 4 illustrates a schematic diagram of yet another motor drive circuit 300 according to an exemplary embodiment. Circuit 300 includes many of the same components as circuit 100, and similar components generally operate in the manner described with respect to FIG. 2. Instead of an electric motor, circuit 300 utilizes a hydraulic blower 305 powered by a hydraulic input 310 and having dual output pipes, one of which is used to cool alternator 110 and one of which is used to cool traction motors 125 and 135.

Circuits 100, 200, and 300 have some limitations. For example, circuits 200 and 300 are not configured to utilize power returned from traction motors 125 and 135 during the retarding operation to drive the traction blower motor; that power is lost as waste heat generated by resistors 140. Circuits 100, 200, and 300 also include components that increase the cost of the drive systems, such as extra blower motors for the alternator (circuits 100 and 200), choppers for the traction blower motor (circuit 100), and hydraulic blowers (circuit 300). Some embodiments also utilize high-voltage electric motors (e.g., alternator blower motor 165 of circuits 100 and 200, traction blower motor 160 of circuit 200) that may be higher in cost and require greater cost and time to repair than low voltage motors. The blower motors may also be connected in a manner such that they may not be easily electrically isolated from the rest of the drive system, in which case the entire drive system of the vehicle may need to be shut down to perform maintenance or repairs on the blower motors. This may increase vehicle downtime and reduce efficiency, which in turn may increase costs and reduce profits associated with a mining or other type of operation with respect to which the vehicle is being used.

Systems and methods for providing power to blower motors of a vehicle such as a mining truck or locomotive that are designed to overcome some of the foregoing limitations are presented below. The systems and methods discussed in detail below may be utilized in large industrial vehicles such as mining trucks. In some embodiments, systems and methods described herein may be utilized in mining trucks such as the Unit Rig™ MT 5500 and MT6300 series, Cat® 793 and 795 series, and/or other mining trucks manufactured by Caterpillar Inc. of Peoria, Ill.

Figure 5:
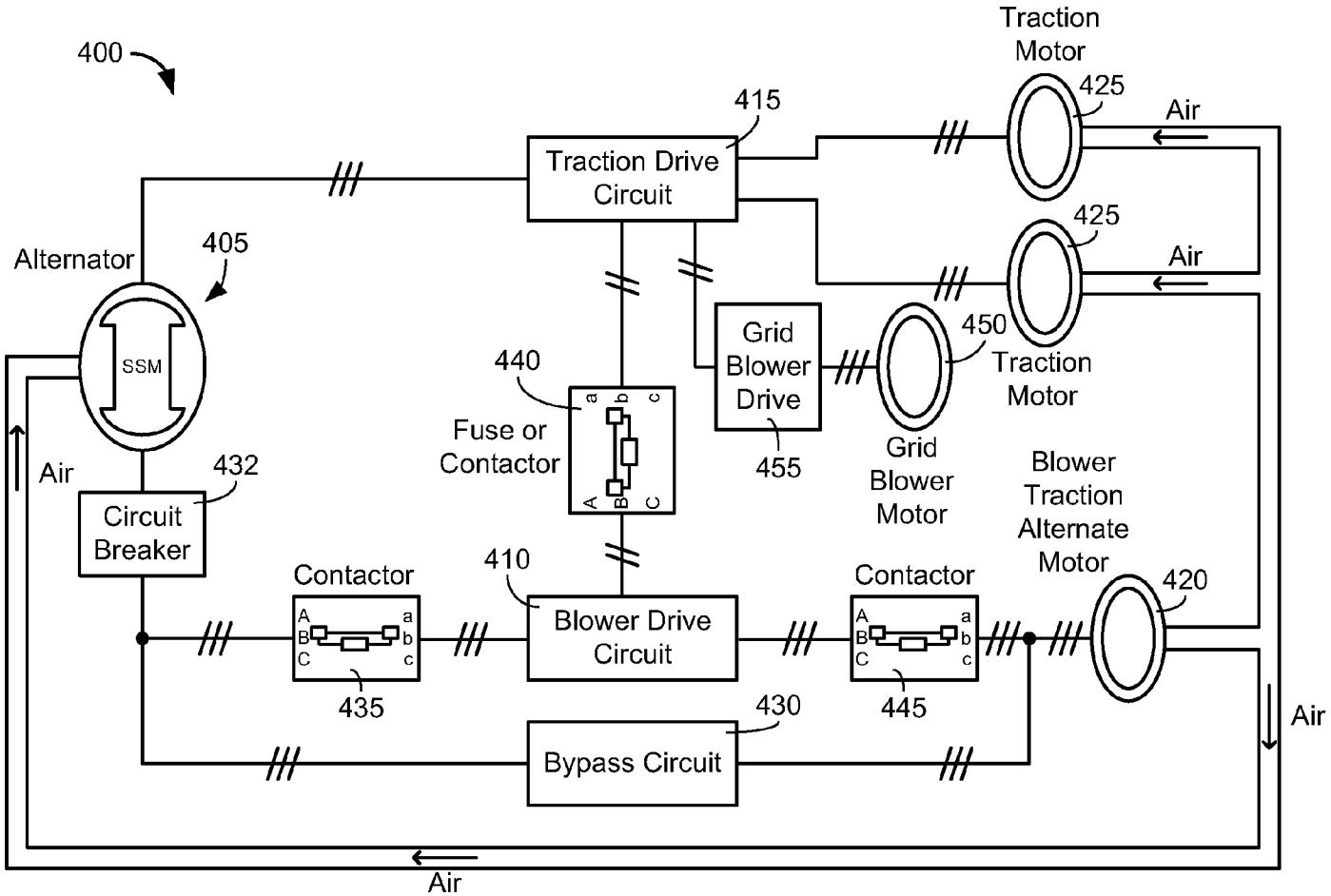
FIG. 5 is a block diagram of a motor drive system including a blower drive circuit according to an exemplary embodiment.

Referring now to FIG. 5, a block diagram of a motor drive system 400 including a blower drive circuit 410 is shown according to an exemplary embodiment. Motor drive system 400 is configured to utilize power returned from traction motors 425 during a retarding operation to help drive a blower motor 420 used to cool traction motors 425 and an alternator 405, increasing the fuel efficiency of the vehicle in which system 400 is utilized. Motor drive system 400 also utilizes a low voltage blower motor 420 that may be less costly than higher voltage blower motors, both in initial cost and in labor and parts cost for maintenance and repairs. Motor drive system 400 is also configured in a manner such that blower drive circuit 410 can be electrically isolated from the rest of system 400 and removed for repair or maintenance without interrupting operation of blower motor 420, decreasing downtime of the vehicle and increasing efficiency of the operation with respect to which the vehicle is being used.

An alternator 405 is configured to convert kinetic energy (e.g., generated by an engine) into electrical energy for use in driving components of an electric drivetrain of the vehicle. The engine may be configured to convert chemical potential energy (e.g., stored in fuel) into kinetic energy (e.g., by way of combustion). The greater the electrical power output demanded from alternator 405, the more fuel may be consumed by the engine to meet the power demand.

Electrical power from alternator 405 may be transmitted to blower drive circuit 410 for use in driving blower motor 420. In some embodiments, blower drive circuit 410, contactors 435, 445, and/or bypass circuit 430 may be used to provide power to two blower motors, one configured to cool alternator 405 and one to separately cool traction motors 425. Blower motor 420 may be configured to cool both alternator 405 and traction motors 425. In some embodiments, blower motor 420 may be a single shaft blower motor and may have a substantially lower operating voltage (e.g., 480 VAC) than an operating voltage of alternator 405 (e.g., 900-2000 VAC). In some embodiments, blower motor 420 may be a double shaft blower motor. Blower drive circuit 410 may be configured to also receive power from traction drive circuit 415. During a retarding operation, traction motors 425 return power to a traction drive circuit 415 configured to receive power from alternator 405 and use the power to drive traction motors 425. At least a portion of the power received from traction motors 425 during the retarding operation may be dissipated by traction drive circuit 415 (e.g., as heat generated by components such as resistors). In some embodiments, a grid blower motor 450 driven by a grid blower drive circuit 455 may be used to cool traction drive circuit 415 as it dissipates energy as waste heat. A portion of the power received from traction motors 425 during the retarding operation may be transmitted from traction drive circuit 415 to blower drive circuit 410 and used in combination with power from alternator 405 to drive blower motor 420.

Motor drive system 400 may be configured to allow blower drive circuit 410 to be electrically isolated from the rest of system 400 in the event of a problem with blower drive circuit 410. For example, blower drive circuit 410 may be designed to include fault detection circuitry configured to detect a problem or fault in one of the components of blower drive circuit 410. Blower drive circuit 410 may be connected to alternator 405 through a circuit breaker 432 and a contactor 435, to traction drive circuit 415 through DC fuses or a contactor 440, and to blower motor 420 through a contactor 445. Contactors 435, 440, and 445 may be closed during normal operation, allowing the flow of power through blower drive circuit 410 to blower motor 420. If a fault is detected in blower drive circuit 410 (e.g., if blower drive circuit 410 is in a fault mode), contactors 435 and 445 may be opened and DC fuses or contactor 440 may be removed or opened (e.g., contacts of the contactors may be opened), electrically isolating blower drive circuit 410 from the rest of system 400. A bypass circuit 430 (e.g., another contactor) may be activated and used to transmit power from alternator 405 to blower motor 420 to enable blower motor 420 to continue to operate while blower drive circuit is isolated. The fault may be addressed without interrupting operation of the vehicle. When the fault is cleared, contactors 435 and 445 and DC fuses or contactor 440 may be closed and bypass circuit 430 may be deactivated, causing power to once again flow through blower drive circuit 410 to blower motor 420. In some embodiments, blower drive circuit 410 may be connected to contactors 435 and 445 and DC fuses or contactor 440 using removable or disconnectable terminal connections so that blower drive circuit 410 can be removed from the vehicle and repaired or maintained in a separate location and the vehicle can continue to operate while blower drive circuit 410 is removed.

Figure 6:
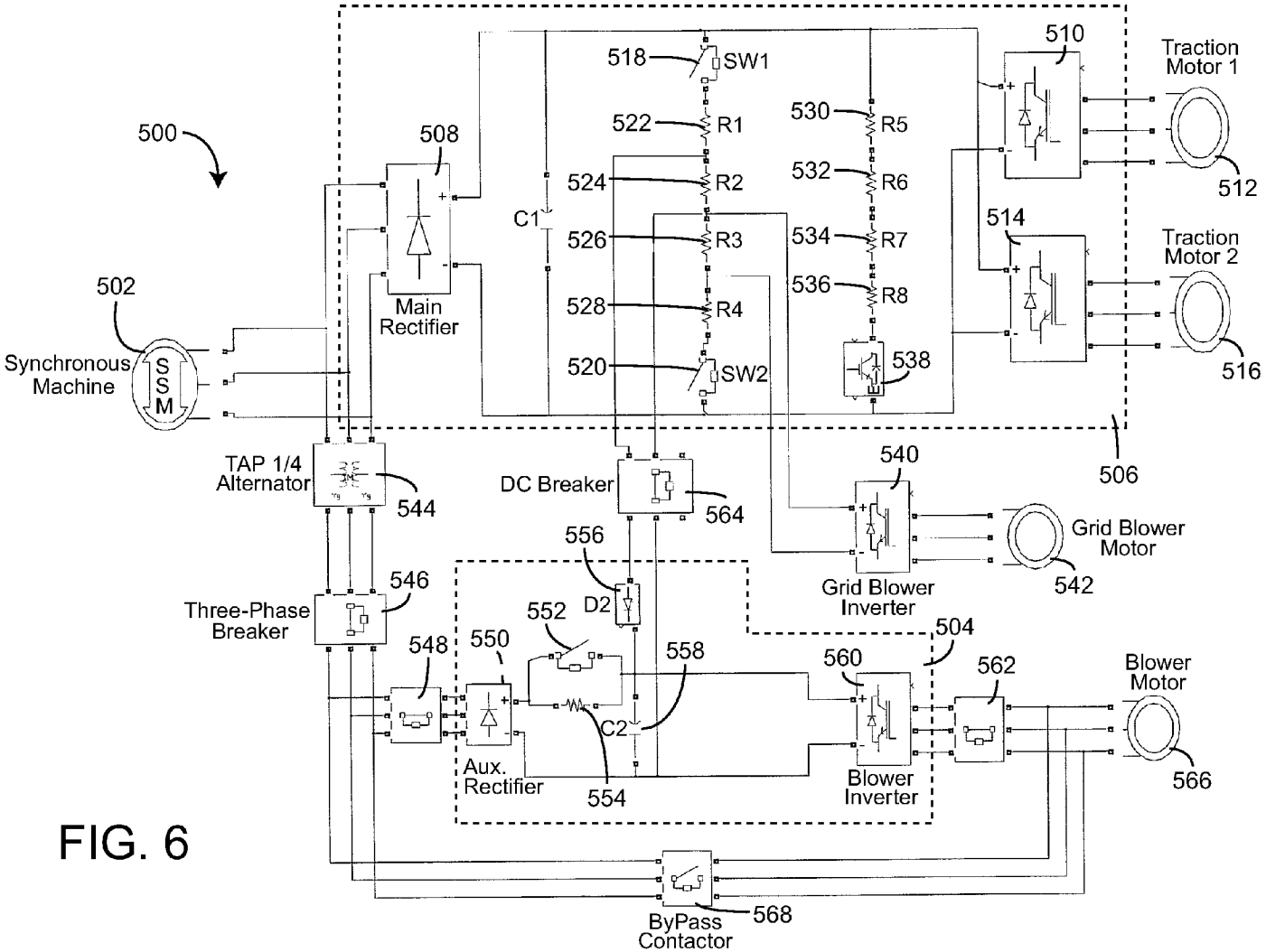
FIG. 6 is a schematic diagram of a motor drive circuit corresponding to the motor drive system of FIG. 5 according to an exemplary embodiment.

Referring now to FIG. 6, a schematic diagram of a motor drive circuit 500 is shown according to an exemplary embodiment. Circuit 500 is an implementation of the motor drive system 400 of FIG. 5 according to one exemplary embodiment. While certain types of components and certain characteristic values are presented for purposes of example in FIG. 6, it should be understood that different types of components and values may be utilized according to various exemplary embodiments of the present disclosure.

An alternator 502 may be configured to convert kinetic energy into electrical power used to drive components of circuit 500. Three-phase AC power is transmitted from alternator 502 to a traction drive circuit 506 configured to drive a first traction motor 512 and a second traction motor 516. In some embodiments, first traction motor 512 may move a left side of the vehicle and second traction motor 516 may move a right side of the vehicle. Traction drive circuit 506 may include a rectifier 508 configured to receive the AC power from alternator 502 and convert it into DC power. The DC power may be transmitted from rectifier 508 to a first inverter 510 configured to drive first traction motor 512 and a second inverter 514 configured to drive second traction motor 516.

Inverters 510 and 514 may be configured to receive the DC power and to convert it into 3-phase AC power used to drive traction motors 512 and 516, respectively.

During a retarding operation of the vehicle, traction motors 512 and 516 may return energy to traction drive circuit 506, and traction drive circuit 506 may be configured to dissipate the returned energy as heat using grid resistors 522-536. Switches 518 and 520 may close, closing the circuit including resistors 522-528 and allowing current to flow across that branch of the circuit. Each of resistors 522-536 may induce a voltage drop across the resistors. In some embodiments, a grid blower motor 542 may be connected to traction drive circuit 506 through an inverter 540 and may be configured to cool grid resistors 522-536. Chopper 538 adjusts the DC voltage in traction drive circuit 506. In some embodiments, if the DC-link voltage of traction drive circuit 506 is more than 2700 V, chopper 538 will adjust the DC-link voltage (e.g., reduce the voltage). Chopper 538 may operate in both the retarding mode and in propulsion mode. Chopper 538 may include an electronic switch such as an insulated gate bipolar transistor (IGBT) or gate turn-off thyristor (GTO).

A blower drive circuit 504 is configured to receive AC power from alternator 502 and to use the power to drive a blower motor 566. In the illustrated exemplary embodiment, AC power from alternator 502 is transmitted through a fractional tap 544 (e.g., a ¼ tap) of alternator 502 to reduce the voltage from a high operating voltage of alternator 502 to a lower transmitted AC voltage. In some embodiments, a second winding in alternator 502 may be used instead of an alternator having a fractional tap. In some embodiments, a transformer (e.g., a 4:1 transformer) may be used instead of an alternator having a fractional tap. The lower voltage AC power is transmitted through a breaker 546 configured to provide protection for blower drive circuit 504 and blower motor 566 and through a contactor 548 that may be used to electrically isolate blower drive circuit 504, as discussed in further detail below. An auxiliary rectifier 550 is used to convert the AC power into DC power.

Blower drive circuit 504 is also connected to traction drive circuit 506 through DC fuses or a DC breaker 564 that may be used to electrically isolate blower drive circuit 504 and a diode 556 configured to allow current flow only from traction drive circuit 506 to blower drive circuit 504 and not in the opposite direction. When a retarding operation is being performed and power is being returned to traction drive circuit 506, a portion of the power may be transmitted from traction drive circuit 506 to blower drive circuit 504 and used to drive blower motor 566. The power received from traction drive circuit 506 at blower drive circuit 504 may be combined with the DC power from rectifier 550 and transmitted to an inverter 560 configured to convert the DC power into 3-phase AC power. The AC power may be transmitted through another contactor 562 that may be used to isolate blower drive circuit 504 and may be transmitted to blower motor 566 to drive operation of blower motor 566. Starting breaker 552 is a contactor that may be opened at a first time when capacitor 558 is discharged. The capacitor will charge via a resistor 554, and then after a short period of time (e.g., 5-15 seconds), starting breaker 552 may be closed. Starting breaker 552 may be opened when the vehicle is shut down.

Circuit 500 is configured such that blower drive circuit 504 may be electrically isolated from the rest of circuit 500. In the event of a fault or other problem with blower drive circuit 504, contactors 548 and 562 and DC fuses or breaker 564 may be opened, causing blower drive circuit 504 to be electrically removed from circuit 500. A bypass contactor 568 may be closed to allow power to continue flowing from breaker 546 to blower motor 566. Using bypass contactor 568, blower motor 566 can continue to operate while blower drive circuit 504 is being repaired or maintained. In some embodiments, the connections between blower drive circuit 504 and contactors 548 and 562 and DC fuses or breaker 564 may be removable, such that the entire blower drive circuit 504 can be physically removed from the vehicle and maintained or repaired at a location remote from the vehicle and the vehicle can continue to operate while blower drive circuit 504 is removed.

Figure 7:
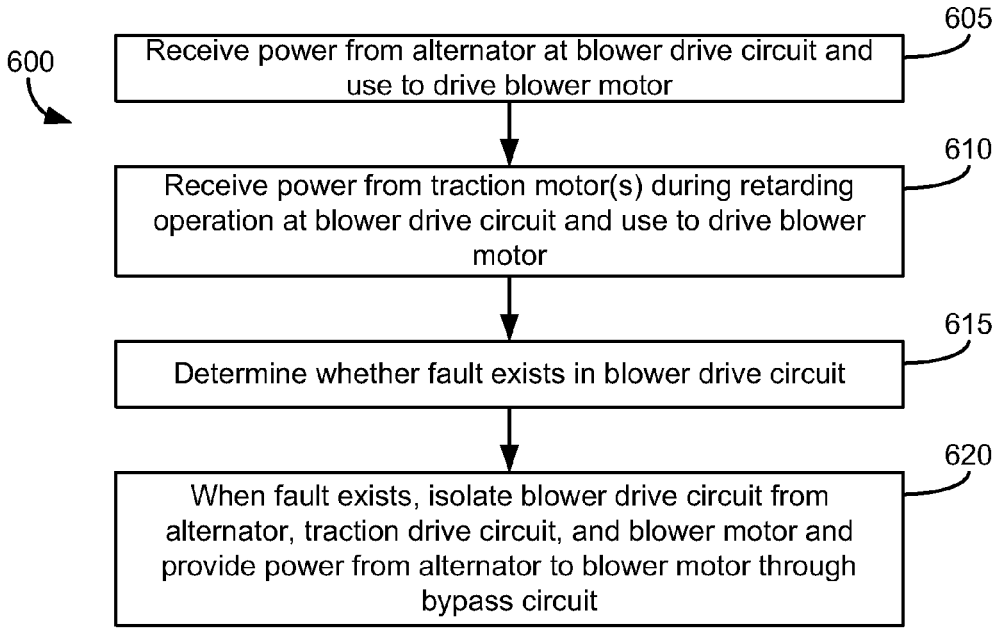
FIG. 7 is a flow diagram of a process for providing power to a blower motor according to an exemplary embodiment.

Referring now to FIG. 7, a flow diagram of a process 600 for providing power to a blower motor is shown according to an exemplary embodiment. In some embodiments, operations of process 600 may be performed using components of system 400 and/or circuit 500.

A blower drive circuit may be configured to receive power from an alternator and use the power to drive the blower motor (605). During a retarding operation, the blower drive circuit may also receive power from traction motors through a traction drive circuit and use the power from the traction motors to supplement the power from the alternator to drive the blower motor (610).

The blower drive circuit may be configured to determine whether a fault exists in any of the circuitry of the blower drive circuit (615). In the event a fault is detected, the blower drive circuit may be isolated from other components of the drive system such as the alternator, traction drive circuit, and blower motor (620). Power may be provided from the alternator to the blower motor through a bypass circuit while the blower drive circuit is isolated. In some embodiments, the blower drive circuit may be removable from the vehicle to allow for the blower drive circuit to be repaired remotely, and the vehicle may be enabled to continue operation using the bypass circuit.

INDUSTRIAL APPLICABILITY

The disclosed electric drive system may be implemented in any vehicle having an electric drive system where blower motors are used to cool components of the vehicle. In some specific exemplary embodiments, the disclosed electric drive system may be implemented in a mining truck (e.g., such as that illustrated in FIG. 1) or in a locomotive. Blowers in a mining truck may be used to push air over the windings of alternators and/or traction motors to cool those components. The disclosed electric drive system may utilize power returned from traction motors to drive the blower motors and reduce the fuel needed to drive the blower motors from the engine. The disclosed electric drive system may also allow for the blower drive circuit of the mining truck to be electrically isolated from the rest of the electric drive system in the event of a fault in the circuit. A bypass circuit may be used to allow the blower to continue cooling the traction motors of the mining truck so the mining truck can continue the mining operation while the fault is being addressed, reducing costly downtime associated with stopping the mining operation until the truck is fixed or replacing the truck with another mining truck.

Referring to FIG. 6, motor drive circuit 500 that may be used in a mining vehicle includes a blower drive circuit 504 configured to drive a blower motor 566. The blower motor 566 may be configured to cool a first traction motor 512 and/or second traction motor 516 of the mining vehicle that are configured to move different portions (e.g., a left and right side) of the mining vehicle. During a retarding operation in which a portion of the mining vehicle is slowed or stopped, first traction motor 512 and/or second traction motor 516 may return electrical power to a traction drive circuit 506. Blower drive circuit 504 may be electrically connected to traction drive circuit 506 in a manner that allows at least a portion of the energy returned from first traction motor 512 and/or second traction motor 516 to be transmitted to blower drive circuit 504 for use in driving blower motor 566. This may reduce the amount of fuel an engine of the mining vehicle consumes to drive alternator 502 to generate electrical power to drive blower motor 566.

In some embodiments, blower drive circuit 504 may be capable of being electrically isolated from other components of motor drive circuit 500 so that the mining vehicle can continue to operate in the event of a fault in blower drive circuit 504. Contactors 548 and 562 and DC fuses or breaker 564 may be used to isolate blower drive circuit 504, and a bypass contactor 568 may be used to transmit power from alternator 502 to blower motor 566 until blower drive circuit 504 is fixed and can be reconnected to the rest of motor drive circuit 500. This may allow the mining vehicle to continue operating while blower drive circuit 504 is being repaired. In some embodiments, blower drive circuit 504 may be removed from the mining vehicle and repaired at another location while the mining vehicle continues performing mining operations.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials and components, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure may contemplate methods, systems and program products on any machine-readable storage media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable storage media for carrying or having machine-executable instructions or data structures stored thereon. Such machine-readable storage media can be any available media that can be accessed by a general purpose or special purpose computer or other machine with a processor. By way of example, such machine-readable storage media can comprise RAM, ROM, EPROM, EEPROM, CD-ROM or other optical disk storage, magnetic disk storage or other magnetic storage devices, flash memory, or any other medium which can be used to carry or store desired program code in the form of machine-executable instructions or data structures and which can be accessed by a general purpose or special purpose computer or other machine with a processor. Machine-readable storage media are tangible storage media and are non-transitory (i.e., are not merely signals in space). Combinations of the above are also included within the scope of machine-readable storage media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps, and decision steps.

What is claimed is:

1. A drive system for a blower motor of a vehicle, the vehicle having at least one traction motor configured to move at least a portion of the vehicle, the blower motor being configured to cool the at least one traction motor, the drive system comprising:

a blower drive circuit configured to receive power from an alternator and use the power from the alternator to drive the blower motor, wherein the blower drive circuit is further configured to receive power from the at least one traction motor during a retarding operation of the vehicle and use the power from the at least one traction motor to drive the blower motor; and a bypass circuit configured to electrically isolate the blower motor from the blower drive circuit when a fault is detected in the blower drive circuit and to provide power from the alternator to the blower motor such that the blower motor remains operable without use of the blower drive circuit;

wherein the blower drive circuit comprises a rectifier and an inverter, wherein the rectifier is configured to convert AC power from the alternator into DC power, wherein the blower drive circuit is configured to receive DC power from the at least one traction motor at a position in the blower drive circuit between the rectifier and the inverter, and wherein the inverter is configured to convert DC power from at least one of the rectifier and the at least one traction motor into AC power to drive the blower motor.

2. The drive system of claim 1, wherein the blower drive circuit is configured to be removable from the vehicle, and wherein the bypass circuit is configured to provide power to the blower motor when the blower drive circuit is removed from the vehicle.

3. The drive system of claim 2, wherein the bypass circuit comprises a plurality of contactors configured to electrically connect the blower drive circuit to the alternator, the at least one traction motor, and the blower motor, wherein, in a blower drive circuit fault mode, the plurality of contactors open contacts to electrically isolate the blower drive circuit from the alternator, the at least one traction motor, and the blower motor, and wherein the blower drive circuit can be disconnected from the plurality of contactors and removed from the vehicle to perform maintenance on the blower drive circuit.

4. The drive system of claim 1, further comprising a traction drive circuit configured to receive power from the alternator and to drive the at least one traction motor with the power from the alternator, wherein, during the retarding operation, the traction drive circuit is configured to receive power from the at least one traction motor, wherein the traction drive circuit comprises a plurality of resistors configured to receive the power from the at least one traction motor during the retarding operation and to dissipate at least a portion of the power received from the at least one traction motor as heat.

5. The drive system of claim 4, wherein the blower drive circuit is connected to the traction drive circuit across at least one of the resistors, and wherein the blower drive circuit is configured to receive a portion of the power received by the traction drive circuit from the at least one traction motor during the retarding operation and to use the power from the traction drive circuit to drive the blower motor.

6. The drive system of claim 5, further comprising a resistor blower motor configured to cool the plurality of resistors of the traction drive circuit, the resistor blower motor being electrically connected to the traction drive circuit and being driven by power received from the at least one traction motor during the retarding operation.

7. The drive system of claim 1, wherein the blower drive circuit is connected to the alternator through one of a fractional tap of the alternator or a transformer, wherein the one of the fractional tap of the alternator or the transformer is configured to reduce an operating voltage of the alternator to a lower voltage received by the blower drive circuit.

8. The drive system of claim 1, wherein the vehicle is a mining truck.

9. A vehicle comprising:

an alternator;

at least one traction motor configured to move at least a portion of the vehicle;

a blower motor configured to cool the at least one traction motor and the alternator;

a traction drive circuit configured to receive power from the alternator and drive the at least one traction motor with the power from the alternator, wherein, during a retarding operation, the traction drive circuit is configured to receive power from the at least one traction motor and to dissipate at least a portion of the power received from the at least one traction motor as heat;

a blower drive circuit configured to receive power from the alternator and use the power from the alternator to drive the blower motor, wherein the blower drive circuit is electrically connected to the traction drive circuit, wherein, during the retarding operation, the blower drive circuit is configured to receive from the traction drive circuit a portion of the power received by the traction drive circuit from the at least one traction motor, and wherein the blower drive circuit is configured to use the power from the at least one traction motor to drive the blower motor; and a bypass circuit configured to electrically isolate the blower motor from the blower drive circuit when a fault is detected in the blower drive circuit and to provide power from the alternator to the blower motor such that the blower motor remains operable without use of the blower drive circuit;

wherein the blower drive circuit comprises a rectifier and an inverter, wherein the rectifier is configured to convert AC power from the alternator into DC power, wherein the blower drive circuit is configured to receive DC power from the at least one traction motor at a position in the blower drive circuit between the rectifier and the inverter, and wherein the inverter is configured to convert DC power from at least one of the rectifier and the at least one traction motor into AC power to drive the blower motor.

10. The vehicle of claim 9, wherein the blower drive circuit is configured to be removable from the vehicle, and wherein the bypass circuit is configured to provide power to the blower motor when the blower drive circuit is removed from the vehicle.

11. The vehicle of claim 10, wherein the bypass circuit comprises a plurality of contactors configured to electrically connect the blower drive circuit to the alternator, the at least one traction motor, and the blower motor, wherein, in a blower drive circuit fault mode, the plurality of contactors open contacts to electrically isolate the blower drive circuit from the alternator, the at least one traction motor, and the blower motor, and wherein the blower drive circuit can be disconnected from the plurality of contactors and removed from the vehicle to perform maintenance on the blower drive circuit.

12. The vehicle of claim 9, wherein the traction drive circuit comprises a plurality of resistors configured to receive the power from the at least one traction motor during the retarding operation and to dissipate at least a portion of the power received from the at least one traction motor as heat.

13. The vehicle of claim 12, wherein the blower drive circuit is connected to the traction drive circuit across at least one of the resistors.

14. The vehicle of claim 13, further comprising a resistor blower motor configured to cool the plurality of resistors of the traction drive circuit, the resistor blower motor being electrically connected to the traction drive circuit and being driven by power received from the at least one traction motor during the retarding operation.

15. The vehicle of claim 9, wherein the blower drive circuit is connected to the alternator through one of a fractional tap of the alternator or a transformer, wherein the one of the fractional tap of the alternator or the transformer is configured to reduce an operating voltage of the alternator to a lower voltage received by the blower drive circuit.

16. The vehicle of claim 9, wherein the vehicle is a mining truck.

17. A method of providing power to a blower motor of a vehicle, the vehicle having at least one traction motor configured to move at least a portion of the vehicle, the blower motor being configured to cool the at least one traction motor, the method comprising:

receiving, at a blower drive circuit, power from an alternator and using the power from the alternator to drive the blower motor;

receiving, at the blower drive circuit during a retarding operation of the vehicle, power from the at least one traction motor and using the power from the at least one traction motor to drive the blower motor;

determining whether a fault exists within the blower drive circuit;

when a fault exists within the blower drive circuit, electrically isolating the blower drive circuit from the alternator, the at least one traction motor, and the blower motor and providing power from the alternator to the blower motor through a bypass circuit to enable the blower motor to remain operable without use of the blower drive circuit; and driving a resistor blower motor configured to cool the plurality of resistors using a portion of the power from the at least one traction motor during the retarding operation.

18. The method of claim 17, further comprising connecting the blower drive circuit to the alternator, the at least one traction motor, and the blower motor through a plurality of contactors with disconnectable terminals, wherein the blower drive circuit can be removed for maintenance without stopping operation of the blower motor.

19. The method of claim 17, wherein the power from the at least one traction motor is received by the blower drive circuit from a traction drive circuit comprising a plurality of resistors configured to dissipate at least a portion of the power from the at least one traction motor as heat, and wherein receiving, at the blower drive circuit during a retarding operation of the vehicle, power from the at least one traction motor comprises receiving power from the traction drive circuit through electrical connections between the blower drive circuit and the traction drive circuit that are connected to the traction drive circuit across at least one of the resistors.

* * * * *